United States Patent [19]

Christini et al.

[11] Patent Number: 4,973,390

[45] Date of Patent: Nov. 27, 1990

[54] PROCESS AND APPARATUS FOR PRODUCING LITHIUM FROM ALUMINUM-LITHIUM ALLOY SCRAP IN A THREE-LAYERED LITHIUM TRANSPORT CELL

[75] Inventors: Roy A. Christini; Eric L. Clark; Robert D. Girt, all of Washingtown Township, Armstrong County, Pa.

[73] Assignee: Aluminum Company of America, Pittsburgh, Pa.

[21] Appl. No.: 217,764

[22] Filed: Jul. 11, 1988

[51] Int. Cl.[5] ..... C25C 3/02

[52] U.S. Cl. ..... 204/68; 204/241; 204/243 R; 204/245; 204/246; 204/247; 204/292; 204/294; 204/279

[58] Field of Search ..... 204/68, 71, 241, 243 R-247, 204/292, 294, 279

[56] References Cited

U.S. PATENT DOCUMENTS

| | | | |
|---|---|---|---|
| 1,534,315 | 4/1925 | Hoopes | 204/67 X |
| 1,534,316 | 4/1925 | Hoopes et al. | 204/245 X |
| 1,534,317 | 4/1925 | Hoopes et al. | 204/245 X |
| 1,534,318 | 4/1925 | Hoopes et al. | 209/67 |
| 1,534,319 | 4/1925 | Hoopes et al. | 204/67 |
| 1,534,320 | 4/1925 | Hoopes | 204/67 |
| 1,534,321 | 4/1925 | Hoopes | 204/67 |
| 1,534,322 | 4/1925 | Hoopes et al. | 204/67 |
| 1,535,458 | 4/1925 | Frary | 204/67 |
| 1,562,090 | 11/1925 | Hoopes | 204/245 |
| 3,904,494 | 9/1975 | Jacobs et al. | 204/67 |
| 3,962,064 | 6/1976 | Brut et al. | 204/245 |
| 4,156,635 | 5/1979 | Cooper et al. | 204/68 |
| 4,183,745 | 1/1980 | Tsumura | 75/68 R |
| 4,209,496 | 6/1980 | Carpenter et al. | 423/210 |
| 4,248,630 | 2/1981 | Balmuth | 75/135 |
| 4,385,964 | 5/1983 | Johnson et al. | 203/50 |
| 4,390,364 | 6/1983 | Yu | 75/67 A |
| 4,411,747 | 10/1983 | Dawless et al. | 204/67 |
| 4,430,174 | 2/1984 | Tsumura | 204/67 |
| 4,436,627 | 3/1984 | McMonigle | 210/695 |
| 4,455,202 | 6/1984 | Sintim-Damoa et al. | 204/68 |
| 4,456,479 | 6/1984 | Harris et al. | 75/63 |
| 4,740,279 | 4/1988 | Müller et al. | 204/243 R X |
| 4,780,186 | 10/1988 | Christini et al. | 204/68 |

FOREIGN PATENT DOCUMENTS

| | | |
|---|---|---|
| 267054 | 5/1988 | European Pat. Off. . |
| 2933065 | 1/1981 | Fed. Rep. of Germany . |
| 79-043811 | 4/1979 | Japan . |

OTHER PUBLICATIONS

M. Schofield, "Developments in Lithium Technology", *Metallurgia,* Dec. 1964, pp. 278-280.

Junius David Edwards et al., "The Aluminum Industry, Aluminum and Its Production," McGraw-Hill Book Company, Inc., New York, 1930, pp. 322-327.

Basant L. Tiwari et al., "Electrolytic Extraction of Magnesium from Commerical Aluminum Alloy Scrap," *Physical Chemistry of Extractive Metallurgy,* AIME, New York, Feb. 1985, pp. 147-164.

Basant L. Tiwari, "Demagging Processes for Aluminum Alloy Scrap," *Journal of Metals,* Jul. 1982, pp. 54-58.

Joseph S. Smatko, "The Lithium Electrolytic Cell", Published by the Office of Military Government for Germany, Apr. 1, 1946.

R. R. Rogers et al., "The Production of Lithium Metal", *The Canadian Mining and Metallurgical Bulletin,* Nov. 1948, pp. 623-628.

Richard Bauer, "Lithium—Electrochemical Aspects", *Chemi-Ing. Techn.,* 44, (4), 1972,pp. 147-151.

*Primary Examiner*—Donald R. Valentine

*Attorney, Agent, or Firm*—Douglas G. Glantz

[57] ABSTRACT

The present invention provides an apparatus for producing lithium from an aluminum-lithium alloy scrap comprising (a) a dryer for removing moisture from solid aluminum-lithium alloy; (b) a reservoir for heating and holding molten aluminum-lithium alloy; (c) a three-layered electrolysis cell comprising a most dense lowest layer of molten aluminum-lithium alloy, a middle layer of molten salt electrolyte, and an uppermost layer of molten lithium; and (d) a reactive gas fluxing unit to remove water present in the molten salt.

20 Claims, 1 Drawing Sheet

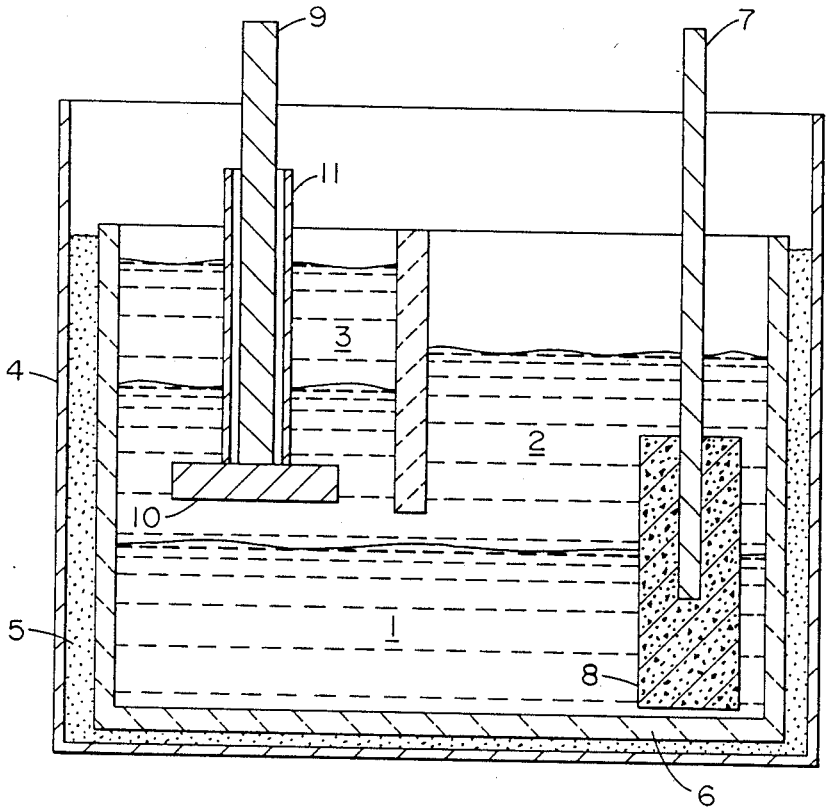
9
7
11
3
4
2
10
5
1
8
6

PROCESS AND APPARATUS FOR PRODUCING LITHIUM FROM ALUMINUM-LITHIUM ALLOY SCRAP IN A THREE-LAYERED LITHIUM TRANSPORT CELL

BACKGROUND OF THE INVENTION

1. Technical Field

This invention relates to apparatus for producing lithium from recycled lithium-containing alloys such as aluminum-lithium alloy scrap.

2. Background of the Prior Art

Lithium is the lightest among the elements that are solid under normal conditions, having a specific weight of about 0.59 g/cm$^3$. This light metal floats on water and oil and also on many molten salts. Lithium was produced for the first time by the electrolysis of lithium chloride. Other starting materials such as lithium bromide or lithium hydroxide have been found to be less desirable in the production of lithium metal for reasons that they are more expensive and that secondary reactions produce low current efficiencies. Lower operating temperatures in the production of lithium from lithium chloride can be achieved by adding other compounds to form low melting point eutectics. For example, a low melting point eutectic is achieved by formulating a composition of LiCl/KCl of about 57/43 mol%. Even lower melting point eutectics are available from compositions such as LiCl/$NaH_4Cl$ and several LiCl/$LiNO_3$ compositions.

In the production of lithium electrolytically from lithium chloride, potassium chloride has been added to the electrolyte melt because of a decomposition potential higher than that for lithium chloride. Decomposition potentials at about 450° C. are 3.68 V for LiCl, 3.57 V for NaCl, and 3.81 V for KCl. Decomposition potentials indicate that potassium will not be reduced as readily as lithium or sodium. Sodium, on the other hand, has a decomposition potential which indicates that sodium is reduced preferentially to lithium. For this reason, sodium contaminants should be eliminated before attempting the production of pure lithium from lithium chloride.

As early as the earliest patents for the production of aluminum electrolytically, lithium compounds were mentioned for use in aluminum electrolysis, but financial aspects limited the universal realization of this proposal until only recently. Lithium fluoride can be used, but lithium carbonate is more economical and reacts under the prevailing conditions with aluminum fluoride to form lithium fluoride and aluminum oxide. The main advantage of lithium addition in aluminum electrolysis is attributable to a reduction in the liquidus temperature of the electrolyte and reductions of melt density and viscosity. A drawback, however, is a reduced solubility for the aluminum oxide. Nevertheless, this drawback can be compensated by reduced calcium fluoride content. Lower temperatures in the electrolysis eventually would freeze the bath, but this can be counteracted by increasing the cell current or by increasing the anode-cathode distance. Lithium compounds have been added to aluminum electrolysis in the amounts of 3 to 5% as lithium fluoride to reduce costs by lower energy consumption by about 3%, to reduce carbon consumption by about 2%, to reduce bath addition by up to 4%, and to reduce fluoride emissions by up to about 50%.

Lithium metal can be produced directly from ore by heating together a mixture of spodumene, lime, and aluminum or silicon to a temperature above about 100° C. at a pressure of 25 microns to produce a lithium-magnesium alloy containing 85–90% lithium. The technical literature has mentioned a method for producing lithium metal by an electrolysis of a fused mixture of lithium and potassium chloride. The technical literature also mentions that electrolysis is employed to form alloys of lithium with metals of low melting points, such as lead, tin, or zinc, wherein the molten heavy metal is used as the cathode and the lithium is electrodeposited from a fused salt mixture containing lithium chloride.

The electrolytic production of lithium alloys has been investigated for alloys of lead, zinc, aluminum, magnesium, and copper-aluminum from starting materials consisting of a fused mixture of equal weights of lithium chloride and potassium chloride. Cathodes of the various alloying metals in the molten state were used.

Pure lithium has been obtained from lead-lithium and copper-aluminum-lithium alloys by distillation at low pressures. Lithium metal has been produced from lithium chloride using electrolytes of lithium chloride and potassium chloride, and, optionally, lithium bromide at a current efficiency of over 90% and a metal yield on the basis of lithium chloride input of 95% in a sodium type of cell. The sodium type of cell has anodes of graphite and cathodes of steel. The cell is heated externally by gas or oil, and the salt mixture is fused between anodes of graphite and cathodes of steel. Current is applied and molten lithium metal is formed. Chlorine is formed at the anode and is vented and recovered from the cell, five pounds of chlorine for each pound of lithium metal produced.

U.S. Pat. No. 3,962,064 discloses lithium formed on a cathode and collected in an electrolytic tank of stainless steel having a solid cathode and anode. An inert gas is introduced into a discharge compartment, and lithium is transferred to that chamber for casting into ingots under inert atmosphere.

Japanese Patent Disclosure No. 79,043,811 discloses a production method for metallic lithium in which mixed salts consisting of 42–52 wt % lithium chloride and 58–48 wt % potassium chloride are electrolyzed in the molten state. The electrolysis is carried out in the molten state by heating the mixed salts at 380°–500° C. at a voltage of 4–12 V and a current density of 50–300 A/dm$^2$. A lithium electroconductive solid electrolyte such as a lithium sulfate, a lithium-beta-alumina, or a lithium alumina silicate are used as a diaphragm for partitioning the cathode and anode chambers used in the electrolysis. When the content of lithium chloride is less than 42 wt %, the ratio of metallic lithium redissolved is markedly increased and electrical resistance is also increased. When the content of lithium chloride exceeds 52 wt %, these same effects occur. Electrodes used in the electrolysis are graphite or carbon for the anode and stainless steel for the cathode.

U.S. Pat. No. 4,455,202 discloses a process for producing lithium by the electroreduction of a lithium compound dispersed in a fused salt electrolyte and deposition of the electroreduced lithium in a liquid metal cathode from which lithium is recovered. A fused salt electrolyte includes a lithium compound and at least one of the following elements of the Periodic Table including Group IIIA, such as boron; Group IVA, such as carbon; Group VA, such as nitrogen; and Group VIA, such as oxygen. The patent discloses the electroreducing of lithium oxide dispersed in such an electrolyte of fused lithium salts and alloying the electroreduced lithium with a liquid metal cathode. Suitable electrolytes are disclosed to be chalcogenides such as $Li_2O$, $K_2O$, CaS, $Na_2S$, $K_2Se$, CaSe, or BaTe; fluorides such as LiF, NaF, KF, $CaF_2$, $BaF_2$, or $SrF_2$; hydroxides such as LiOH, NaOH, KOH, or $Ca(OH)_2$; sulfates such as $Li_2SO_4$, $Na_2SO_4$, $K_2SO_4$, or $SrSO_4$; nitrates such as $LiNO_3$, $NaNO_3$, $KNO_3$, or $Ca(NO_3)_2$; carbonates such as $Li_2CO_3$, $Na_2CO_3$, $K_2CO_3$, $CaCO_3$, or $SrCO_3$; and mixtures of all the preceding.

The Hoopes cell process includes feeding an impure aluminum or aluminum alloy in a molten state as an anode in contact with a superimposed bath or electrolyte preferably containing one or more fused fluorides with or without the addition of chlorides, the pure aluminum being deposited on the cathode of molten aluminum preferably floating on the bath or electrolyte. The Hoopes cell is disclosed in U.S. Pat. Nos. 1,534,317 and 1,534,318. The preferred electrolyte or bath in the Hoopes cell contains 25–30% aluminum fluoride, 30–38% barium fluoride, 25–30% sodium fluoride, 0.5–3% alumina, and 2% calcium and magnesium fluorides present as impurities.

Aluminum-lithium alloys currently are receiving more attention as candidates for use in structural metal applications in the aerospace industry. Aluminum-lithium alloys offer the advantage of lighter weight and high structural integrity, making these alloys attractive to the aerospace industry for saving fuel.

Large quantities of scrap are generated for every pound of metal used in an aircraft. It is desirable to recycle most of this scrap into ingot form for further processing and application in new products, such as aircraft plate or sheet or aircraft extrusions. However, since several different alloys are used, mixed scrap may not be recyclable in whole or even in part by melting the scrap and forming the ingot directly. If scrap cannot be recycled into new aluminum-lithium ingot, some method must be found to remove and recover the lithium from the scrap. Processes that lead to the production of both lithium and lithium-free aluminum are desirable.

The electrolytic processes described above have one or more drawbacks or disadvantages which have been found to be undesirable in the pursuit of reclaiming lithium from aluminum-lithium alloy scrap.

It is an object of the present invention to provide apparatus for producing lithium from recycled aluminum-lithium alloy scrap.

It is a further object of the present invention to provide apparatus for producing lithium in a three-layered lithium transport cell.

It is yet another object of the present invention to provide a refractory for containing the liquids in the three-layered lithium transport cell.

These and other objects of the present invention will become apparent from the detailed description of the invention as follows.

SUMMARY OF THE INVENTION

The present invention provides apparatus for producing lithium from an aluminum-lithium alloy scrap including a dryer for removing moisture from solid aluminum-lithium alloys; a reservoir for heating and for holding molten aluminum-lithium alloy; a three-layered electrolysis cell including a most dense lowest layer of molten aluminum-lithium alloy, a middle layer of molten salt electrolyte, and an uppermost layer of molten lithium. In one aspect, the apparatus further includes a reactive gas fluxing unit to remove water or hydroxides present in the molten salt. The apparatus of the present invention includes unique refractory containment materials of brick and mortar comprising magnesium oxide or magnesium aluminate, or both.

BRIEF DESCRIPTION OF THE DRAWING

The Figure illustrates in some detail the components of the electrolytic cell used to carry out the process of the invention.

DETAILED DESCRIPTION

The Figure represents the apparatus of the present invention which involves a lithium transport cell set up as a three-layered electrolytic cell. The lowest layer 1 of the three-layered cell is formed by an aluminum-lithium alloy layer having a density of about 2.1 g/cc. As will be seen from the following description, this lowest layer of aluminum-lithium alloy will have the highest density of the three layers in the three-layered electrolytic cell. This lowest layer of aluminum-lithium alloy is made anodic. An intermediate salt bath layer 2 of lithium chloride or lithium chloride and potassium chloride or lithium chloride, potassium chloride and lithium fluoride has a density of about 1.5 g/cc. An uppermost lithium layer 3 has the lowest density of the three layers in the cell at about 0.5 g/cc, and the uppermost layer of lithium thereby floats on the intermediate layer of salt bath. Lithium is produced at a cathode which is submerged in the salt bath.

The apparatus of the present invention includes two elements to remove moisture from the molten salt and separately from the aluminum-lithium scrap. A preliminary moisture removal element involves a reactive gas fluxing unit to remove water present as hydroxide ion. A second moisture removal element involves a dryer unit for aluminum-lithium alloy preferably operating to withdraw moisture to a level below about 0.1%. The apparatus of the present invention incorporates the two preliminary moisture removal elements to avoid problems which occur in the form of the bath becoming very thick and foamy. In such a situation, sampling becomes very difficult, and lithium drops on the surface of the bath do not coalesce due to oxides in the bath that inhibit coalescence. In one aspect, the apparatus of the present invention includes means for controlling the atmosphere above the lithium pool in the three-layered electrolytic cell such that moisture is prevented from entering the low moisture system.

The lithium transport cell of the present invention requires apparatus comprising unique insulating refractories for containment of the three layers in the cell. Three liquid phases forming the three-layered electrolytic cell, comprising aluminum-lithium, bath, and lithium are very corrosive to most materials. Materials of construction may include refractory mortars, and these too must be compatible with the three corrosive phases in the lithium transport cell used in the process of the present invention. Magnesium oxide and magnesium aluminate have been found to outperform all materials in contact with lithium, and perform well in contact with aluminum-lithium alloy. However, typical magnesium oxide or magnesium aluminate materials are contaminated with at least some level of calcium and sometimes sodium. The apparatus of the present invention includes a magnesium oxide or magnesium aluminate containment material and, in one aspect, further includes a magnesium oxide mortar having reduced levels of calcium oxide and sodium oxide impurities. The apparatus of the present invention operates to avoid the action of aluminum-lithium alloy reducing the calcium oxide and sodium oxide impurities out of magnesium oxide or magnesium aluminate brick or mortar, and also avoids the leaching action of the molten salt which introduces calcium and sodium as calcium chloride and sodium chloride into the molten salt.

The apparatus of the present invention, in one aspect, includes mortar-free construction of the aluminum-lithium alloy melter and three layer lithium transport cell. An outermost metal box 4 is constructed of Inconel (TM) for molten salt containment. A layer of magnesium oxide or magnesium aluminate powder 5 is placed in the bottom of the metal box. The magnesium oxide or magnesium aluminate bricks 6 are then placed dry on top of the powder. The containment box is then built in place, backfilling the gap between the containment wall and the metal box with more powder. When ready to operate, the inner cavity is filled with fluxed (pretreated) molten salt. The molten salt saturates the powder and fills the gaps between the bricks. When molten aluminum-lithium alloy is added, the molten salt acts as a liquid mortar preventing the molten alloy from leaking out of the box. The high surface tension between the molten salt and either metal phase appears to prevent penetration.

The anode connection to the aluminum-lithium alloy molten pool is of two-piece construction: an upper nickel rod 7 for high current carrying capability and a lower graphite block 8 for contact with the molten aluminum-lithium alloy. Even though the lithium in the alloy intercalates into the graphite, there is no significant detrimental effect.

The cathode is a three-piece construction: an upper nickel rod 9 for high current carrying capability, which is welded to a lower stainless steel (304L or 316L) plate 10 for contact with the molten lithium and molten salt, and a sheath of stainless steel pipe 11 to protect the lower portion of the nickel rod from attack.

The apparatus of the present invention is operated at temperatures above about 660° C., preferably above about 680° C., and more preferably at a minimum temperature of about 700° C. Lithium melts at about 180° C., lithium chloride at about 608° C., lithium chloride-potassium chloride-lithium fluoride compositions rich in lithium chloride at about 350°-608° C., and aluminum-lithium alloys at about 630°-660° C. The apparatus of the present invention is operated to have all three phases in the three-layered electrolytic cell liquid at the same time. For this reason, the cell must be operated above the temperature of about 660° C.

When direct current is applied to flow through the three-layered cell of the present invention, lithium is oxidized at the alloy-bath interface. Simultaneously, other lithium ions are reduced to lithium metal at the cathode submerged in the salt bath. Impurities present in the alloy or in the bath will determine the quality of the lithium produced. At the lower alloy-bath interface, the sequence of ions oxidized is potassium, lithium, calcium, sodium, magnesium, and aluminum, in that order. However, the lithium, calcium, and sodium ions are oxidized approximately at the same rate. For this reason, any potassium, calcium, or sodium impurities oxidize into the bath under the same conditions as lithium. Levels of calcium and sodium in the alloy must be held to insignificant levels. Calcium or sodium content must be held to levels less than about 0.2 wt % calcium or less than about 0.2 wt % sodium. As noted, neither magnesium nor aluminum oxidize before lithium. Therefore, lithium can be removed without magnesium or aluminum contamination. Magnesium and aluminum only begin to oxidize under limiting conditions, i.e., when the lithium in the alloy has been reduced below some threshold minimum and when the current density at the alloy-bath interface is so high that ions are oxidized indiscriminately. Close monitoring of process control is important to achieve a high lithium product purity.

Pure lithium can be produced at the cathode only so long as two important criteria are controlled.

The lithium content in the aluminum-lithium alloy cannot be reduced to below 0.1–0.3 wt % Li or oxidation of aluminum and/or magnesium will start. Once the bath is contaminated with aluminum or magnesium, these elements will be reduced preferentially at the cathode. Thus, pure lithium cannot be produced.

The second criteria is anode current density. The anode current density must be controlled at less than about 6 amps/square inch. At anode current densities greater than 6 amps/square inch, oxidation at the anode surface (aluminum-lithium alloy-bath interface) is indiscriminate. Aluminum and magnesium oxidize at rates comparable to lithium. The bath is again contaminated and pure lithium cannot be produced. The anode surface area is defined here as the total aluminum-lithium alloy-bath surface area.

At the cathode, the sequence of ions reduced is reversed since the reverse reaction of reduction is occurring. Any aluminum or magnesium in the bath is reduced to metal before lithium. Sodium and calcium would be reduced essentially simultaneously with lithium. On the other hand, potassium will not be reduced at all until the lithium in the bath has been essentially depleted.

Bath composition must be controlled at specified concentrations of bath constituents. The bath composition is controlled not to contain any cation more easily reduced than lithium. For this reason, the bath composition is controlled not to contain aluminum chloride, magnesium chloride, sodium chloride, or calcium chloride. The bath composition contains lithium chloride, potassium chloride, and lithium fluoride, for reasons explained hereinbelow.

It has been found that the bath composition should be controlled to contain a composition of about 55–100 wt % lithium chloride, 0–45 wt % potassium chloride, and 0–10 wt % lithium fluoride. A more preferred composition comprises lithium chloride at 65–75 wt %, potassium chloride at 25–30 wt %, and lithium fluoride at 4–6 wt %. At preferred concentrations, lithium recovery has been found to be higher. The addition of 5–10 wt % lithium fluoride enhances aluminum-lithium and lithium coalescence, thus facilitating tapping the two liquid metals from the three-layered cell.

Two very distinct limits exist for the molten salt composition. High lithium chloride contents (>90 wt %) produce low lithium recoveries attributable to lithium metal dissolution in the bath. The cell can be operated but recoveries are less than optimum.

Low lithium chloride contents (<55 wt %) lead to destructive reactions between the molten salt and the graphite anode when direct current is applied. These destructive reactions do not occur at higher lithium chloride contents.

While the invention has been described in terms of preferred embodiments, the claims appended hereto are intended to encompass all embodiments which fall within the spirit of the invention.

What is claimed is:

1. Lithium-transport cell apparatus for producing lithium from an aluminum-lithium alloy scrap comprising:

(a) a dryer for removing moisture from solid aluminum-lithium alloy;

(b) a reservoir for heating and holding molten aluminum-lithium alloy; and (c) a three-layered electrolysis cell for containing a layer of molten aluminum-lithium alloy, a middle layer of molten salt electrolyte, and a layer of molten lithium, wherein said cell is constructed of a containment material of magnesium compound having less than about 0.2 wt % calcium and less than about 0.2 wt % sodium.

2. The apparatus as set forth in claim 1 further comprising a reactive gas fluxing unit for removing water present in the molten salt.

3. The apparatus as set forth in claim 2 further comprising means for controlling the atmosphere above said three-layered cell to prevent moisture from entering any of the three layers in said cell.

4. The apparatus as set forth in claim 3 wherein said containment material comprises mortarless magnesium oxide or magnesium aluminate bricks on a powder layer of magnesium oxide or magnesium aluminate.

5. The apparatus as set forth in claim 4 wherein the sidewalls include mortarless bricks of magnesium oxide or magnesium aluminate with a powder backup.

6. The apparatus as set forth in claim 5 further comprising an anode having a nickel rod contacting a graphite block and a cathode having a nickel rod in a stainless steel sheath and contacting a stainless steel plate.

7. The apparatus as set forth in claim 6 further comprising an outermost box for salt containment.

8. The apparatus as set forth in claim 7 wherein said powder comprises a powder saturated with molten salt.

9. The apparatus as set forth in claim 3 wherein said cell includes an anode composed of two parts: an upper nickel rod for high current carrying capability, and a lower graphite block for contacting the molten aluminum-lithium alloy.

10. The apparatus as set forth in claim 9 wherein said cell includes a cathode composed of three parts: an upper nickel rod for high current-carrying capability, a sheath of stainless steel pipe to protect the nickel rod from attack, and a lower stainless steel plate for contacting the molten lithium and molten salt.

11. The apparatus as set forth in claim 1 wherein said electrolysis cell containment material comprises a construction of brick and mortar.

12. The apparatus as set forth in claim 11 wherein said containment material comprises magnesium oxide or magnesium aluminate.

13. The apparatus as set forth in claim 1 wherein said containment material comprises a mortarless construction of bricks.

14. A process for producing lithium from an aluminum-lithium alloy scrap in a lithium-transport cell comprising:

(a) feeding aluminum-lithium alloy scrap to a three-layered lithium-transport electrolysis cell comprising a layer of molten aluminum-lithium alloy, a layer of molten salt electrolyte, and a layer of molten lithium; and (b) containing said layers with an insulating refractory of a magnesium compound containing less than about 0.2 wt % calcium and less than about 0.2 wt % sodium.

15. A process as set forth in claim 14 wherein said containment step is carried out by incorporating an insulating refractory of bricks comprising magnesium oxide or magnesium aluminate.

16. A process as set forth in claim 15, said containing step including binding said bricks with magnesium oxide mortar having less than about 0.2 wt % of calcium oxide and less than about 0.2 wt % sodium oxide.

17. A process as set forth in claim 15, said containing comprising constructing without a mortar magnesium oxide or magnesium aluminate bricks onto a powder layer.

18. A process as set forth in claim 17 further comprising constructing sidewalls of said cell with bricks of magnesium oxide or magnesium aluminate.

19. A process as set forth in claim 18 further comprising providing an outermost metal box in said cell for salt containment.

20. A process for recovering lithium from an aluminum-lithium alloy scrap in a lithium-transport cell comprising:

(a) feeding a molten reservoir of aluminum-lithium alloy to a three-layered lithium-transport electrolysis cell which comprises a layer of molten aluminum-lithium alloy, a layer of molten salt electrolyte, and a layer of molten lithium;

(b) passing direct current through the lithium-transport cell with the aluminum-lithium alloy anodic, to oxidize lithium out of the alloy;

(c) reducing lithium ions to lithium metal at a cathode suspended in the molten salt electrolyte;

(d) removing lithium from said uppermost layer in said three-layered electrolysis cell; and (e) containing said layers with an insulating refractory comprising magnesium oxide or magnesium aluminate having less than about 0.2 wt % of calcium or sodium.

* * * * *

UNITED STATES PATENT AND TRADEMARK OFFICE

CERTIFICATE OF CORRECTION

PATENT NO. : 4,973,390

DATED : November 27, 1990

INVENTOR(S) : Roy A. Christini, Eric L. Clark, Robert D. Girt

It is certified that error appears in the above-identified patent and that said Letters Patent is hereby corrected as shown below:

Claim 15, Col. 8, line 20 — Change "containment" to --containing--.

Signed and Sealed this

Thirty-first Day of March, 1992

*Attest:*

HARRY F. MANBECK, JR.

*Attesting Officer*

*Commissioner of Patents and Trademarks*